US005403115A

United States Patent [19]

Flader

[11] Patent Number: 5,403,115

[45] Date of Patent: Apr. 4, 1995

[54] FIBERGLASS REINFORCED PAVEMENT MARKER

[75] Inventor: Michael E. Flader, Gurnee, Ill.

[73] Assignee: Stimsonite Corporation, Niles, Ill.

[21] Appl. No.: 78,968

[22] Filed: Jun. 17, 1993

[51] Int. Cl.[6] ..... E01F 9/00

[52] U.S. Cl. ..... 404/9; 404/12; 404/14; 404/16

[58] Field of Search ..... 404/9–16; 428/261, 224, 228; 524/494

[56] References Cited

U.S. PATENT DOCUMENTS

| | | | |
|---|---|---|---|
| 2,065,872 | 12/1936 | Rockwell | 404/16 |
| 3,164,071 | 1/1965 | Rubenstein | 404/10 |
| 3,332,327 | 10/1967 | Heenan | 404/16 |
| 4,113,907 | 9/1978 | Haage et al. | 428/228 |
| 4,232,979 | 11/1980 | Johnson et al. | 404/16 |
| 4,340,319 | 7/1982 | Johnson, Jr. et al. | 404/16 |
| 4,726,706 | 2/1988 | Attar | 404/14 |
| 5,155,146 | 10/1992 | Reetz | 523/222 |

*Primary Examiner*—Ramon S. Britts
*Assistant Examiner*—Pamela A. O'Connor
*Attorney, Agent, or Firm*—Jones, Day, Reavis & Pogue

[57] ABSTRACT

A potted shell style pavement marker reinforced with fiberglass in the form of a mat of fiberglass strands located near the bottom of the marker or in the form of chopped fiberglass strands distributed throughout the fill material. The mat provides support against torsional or bending stresses near the bottom of the marker. The chopped strands in the fill material provide three-dimensional support throughout the height and depth of the fill in the interior of the housing. Both means of support are expected to reduce the number of cracks that develop in the fill, to prevent the expansion of any cracks which do develop, to prevent premature disintegration of the marker, and to increase average marker life. The supporting mat and the chopped fiberglass strands can be used together in a single marker.

12 Claims, 2 Drawing Sheets

FIBERGLASS REINFORCED PAVEMENT MARKER

FIELD OF THE INVENTION

The present invention relates generally to reflective markers which are intended to be permanently mounted to a roadway surface. The invention more specifically relates to a permanently mountable roadway marker which is resistant to impact damage.

BACKGROUND OF THE INVENTION

Pavement markers have become widely accepted as permanent installations for providing visible signals which mark traffic lanes and control the flow of traffic on roadways in combination with, or in place of, conventional painted traffic lines. A large number of such markers employ retroreflectors which retroreflect light emanating from oncoming vehicles to provide a signal visible to the operators of such oncoming vehicles.

Reflective pavement markers are designed to withstand high impact forces expected to be encountered on the highway. One of the earlier types of markers of the style generally still used today is shown in the Heenan U.S. Pat. No. 3,332,327. In the basic structure shown in the '327 patent, the plastic retroreflectcr elements are first formed as part of the walls of a hollow shell, and then a layer of metal, by vacuum metallization, is deposited on the cube corner retroreflector elements. Following that step, the "shell" is filled or "potted" with a rigid epoxy-type material. The resulting structure is relatively rigid and over the years has proven to be remarkably durable in use.

In spite of the success of road markers utilizing the potted shell design, the potting material is relatively brittle and can prematurely crack from repeated vehicular impacts. Cracking of the interior fill weakens the marker and, upon further impacts, may cause partial or complete fracture in the external shell, dislodging of the marker from the pavement, and partial loss of retroreflectivity of the lens due to separation of the potting material and reflective coating from the cube corners. This phenomenon can be more pronounced when the marker is secured to uneven pavement.

It is an object of the present invention to provide a potted shell type retroreflective pavement marker which has increased resistance to impact damage.

It is another object of the present invention to provide an improved potted shell type retroreflective pavement marker which has increased useful life.

It is yet another object of the present invention to provide a potted shell type retroreflective pavement marker which is less susceptible to deterioration when secured to an uneven pavement surface.

Other and further objects of the invention are apparent from the following discussion of the invention and the preferred embodiments.

SUMMARY OF THE INVENTION

The present invention provides a pavement marker having all the advantages of the potted shell design, but with less susceptibility to premature failure as a result of cracking of the potting material. The invention contemplates the use of one or both of two fiberglass reinforcements. It has been discovered that a mat of woven fiberglass can be formed into the fill material near the bottom of the marker to provide extra torsional and/or bending strength. Furthermore, the mat distributes impact loading along the plane of the marker bottom and creates a lattice to hold the potting material together. Hence, cracks are less likely to occur in the interior of the marker and, if they do occur, less likely to propagate and result in partial or complete marker failure.

A second type of fiberglass reinforcement is obtained by distributing chopped fiberglass strands throughout the potting material. The fill material normally mixes a binding epoxy or polyurethane with a relatively inexpensive, non-binding fill material. It has been discovered that the addition of a relatively small percentage of chopped fiberglass strands to the mixture reduces the brittleness of the potting matter and its susceptibility to deterioration from repeated severe impacts. The homogeneously distributed strands appear to create a three-dimensional matrix, bridging and holding together adjacent areas of the potting material which otherwise would separate under stress.

The two fiberglass reinforcements will supplement each other and can be used together in a single marker. However, it may be desirable for particular applications or for economic reasons to use only one of the two types of reinforcements.

BRIEF DESCRIPTION OF THE DRAWINGS

The present invention will be more fully understood in conjunction with the accompanying drawings in which like numbers indicate like components.

DETAILED DESCRIPTION OF THE PREFERRED EMBODIMENTS

Figure 1:
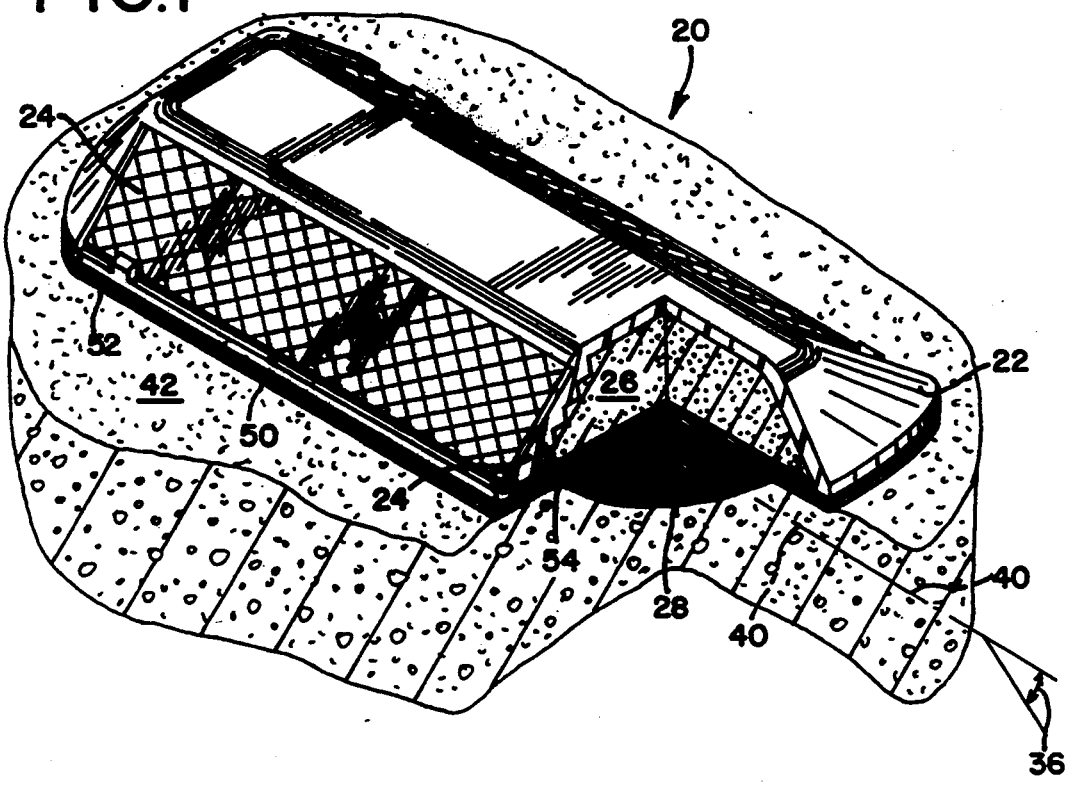
FIG. 1 is a top perspective view of a first preferred embodiment of the present invention installed on a roadway, with breakaway view to reveal the mat of woven fiberglass.
Figure 2:
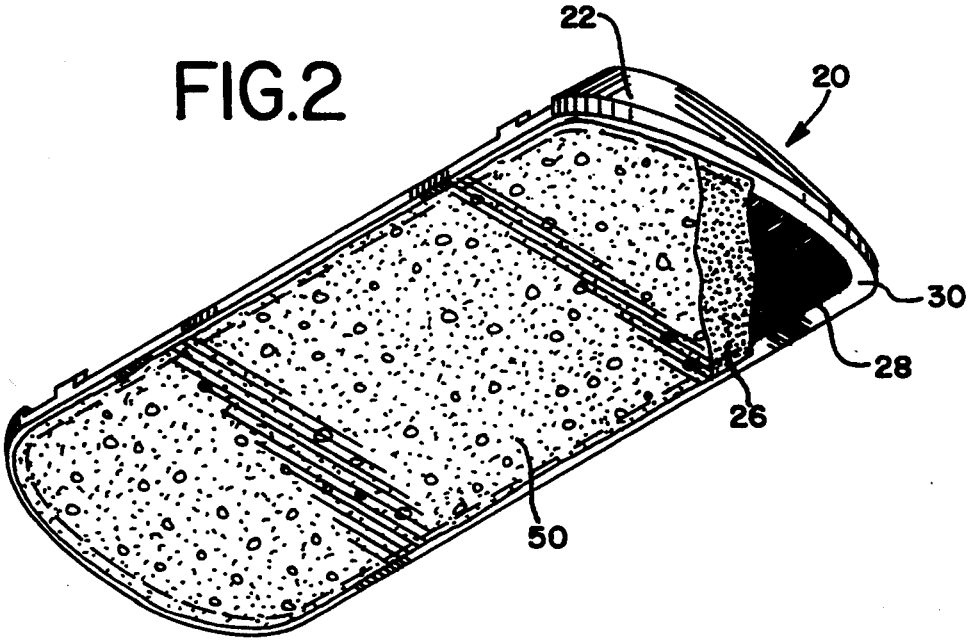
FIG. 2 is a bottom perspective view of the first preferred embodiment, with breakaway view to reveal the position of the mat of woven fiberglass relative to the bottom surface of the marker.
Figure 3:
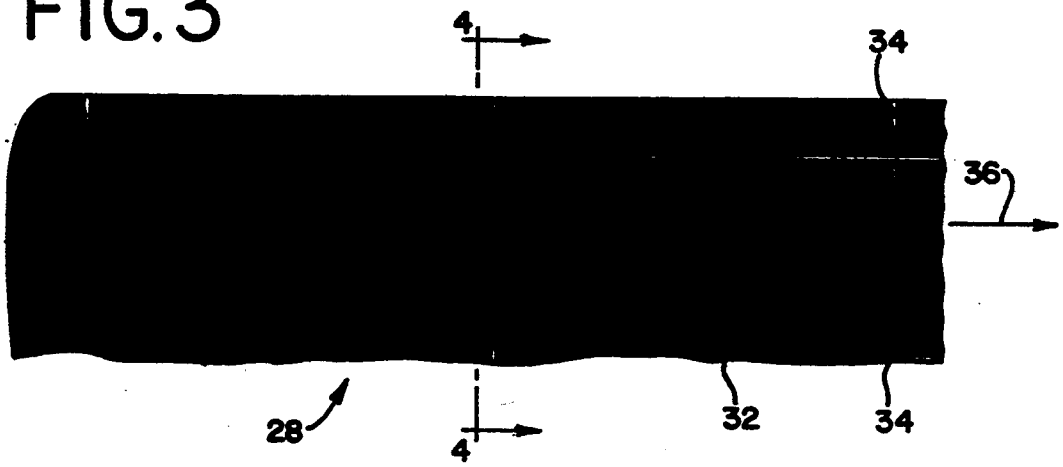
FIG. 3 is a top plan view of the mat of woven fiberglass.
Figure 4:
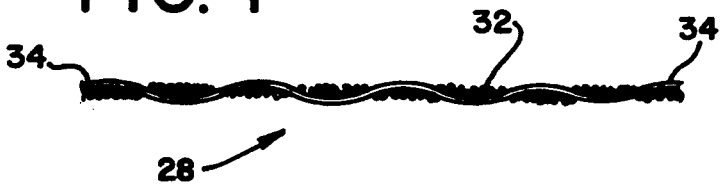
FIG. 4 is a magnified view of a cross-section of the mat taken at section line 4—4 in FIG. 3.
Figure 5:
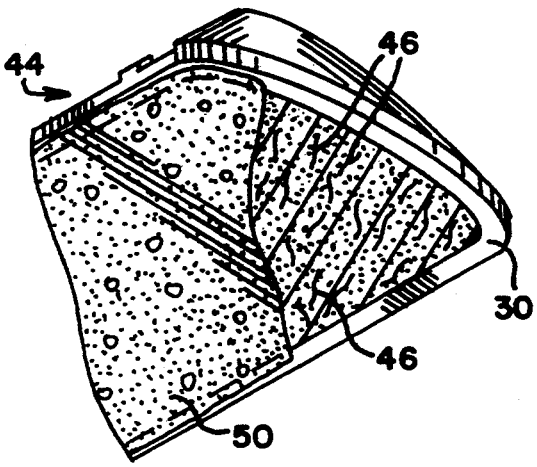
FIG. 5 is a top perspective view of a second preferred embodiment with breakaway view to reveal the strands of chopped fiberglass distributed throughout the potting material in the interior of the marker.
Figure 6:
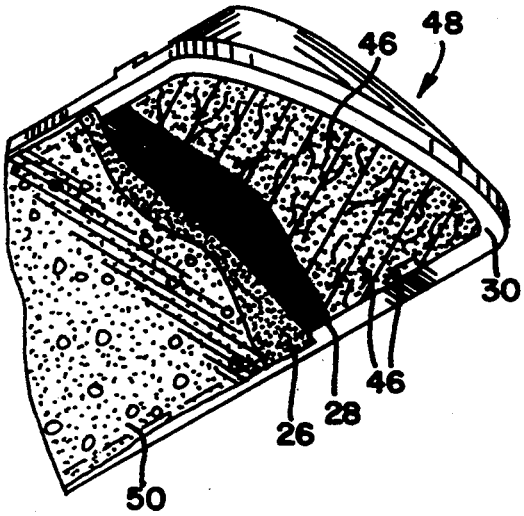
FIG. 6 is a top perspective view of a third embodiment with breakaway view to reveal both the mat of woven fiberglass and the distributed strands of chopped fiberglass.
Figure 1:
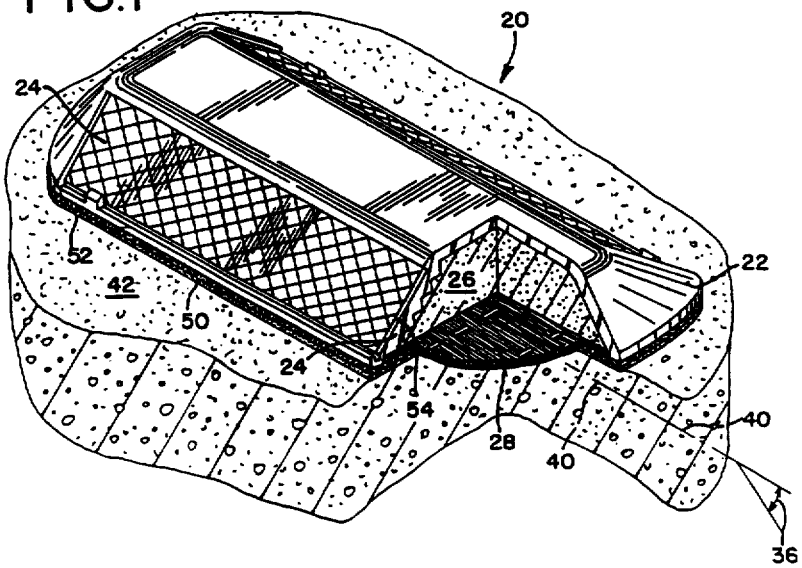
Figure 2:
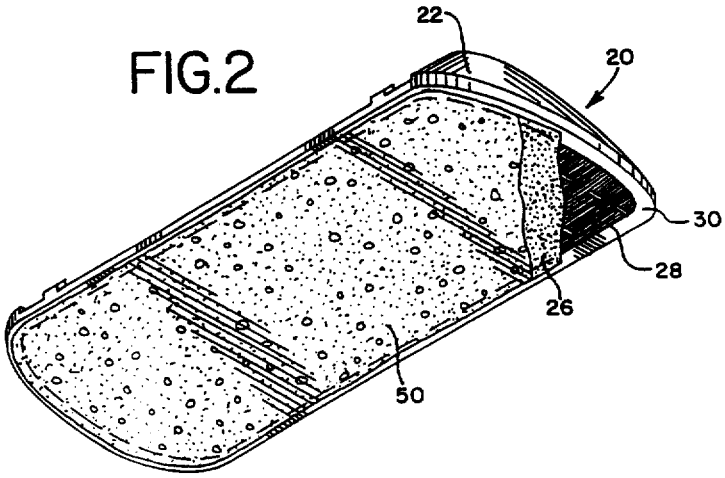
Figure 3:
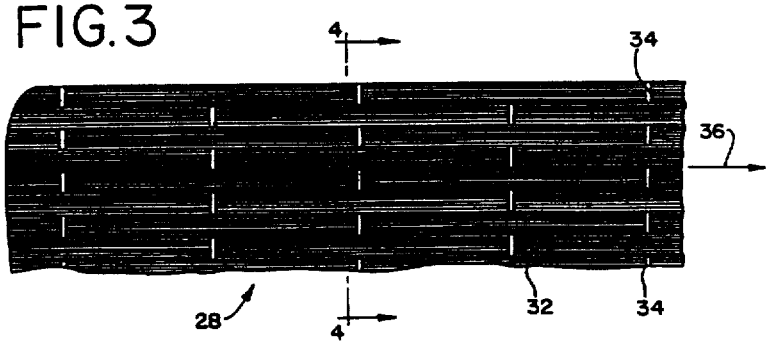
Figure 4:
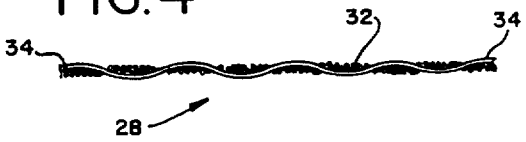
Figure 5:
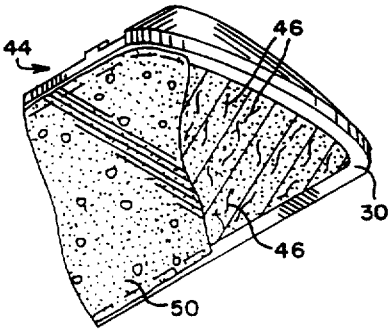
Figure 6:
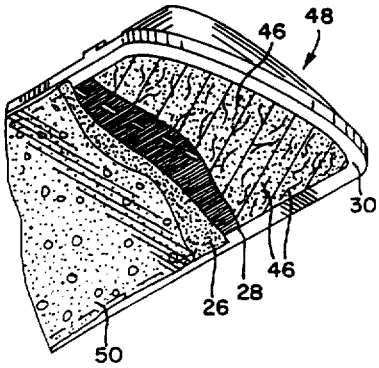

FIGS. 1–6 show three preferred embodiments of the inventive pavement marker. The first embodiment is shown in FIGS. 1–2, the second preferred embodiment is shown in FIG. 5, and the third preferred embodiment is shown in FIG. 6. FIGS. 3–4 show the fiberglass mat before it is incorporated into the embodiments shown in FIGS. 1–2 and 6.

With reference to FIGS. 1–4, the first preferred embodiment is designated as 20. It is generally comprised of a hollow, impact resistant thermoplastic shell or housing 22, retroreflective lenses 24, and fill material 26 filling the interior of the housing. The construction and design of the potted marker of which the present invention is an improvement is described in detail in Heenan U.S. Pat. No. 3,332,327, incorporated by reference herein.

The first preferred embodiment contains a mat of woven fiberglass 28 incorporated into the fill material 26 near the bottom 30 of the marker 20. The mat 28 is placed in the liquid fill material 26 just after it is poured or otherwise dispensed into the hollow housing 22 and while it is still in a fluid or semi-fluid state. The fill material 26 soaks into and through the mat 28 and secures the mat in place near the bottom surface 30 when it hardens. Locating the mat 28 near the bottom 30 gives reinforcement to the marker at the plane of greatest bending stresses to which the marker is exposed during service.

The fiberglass mat 28 is a thin layer of individual longitudinal strands 32 of fiberglass which are held together by perpendicular strands 34 of, preferably, fiberglass or, alternatively, some other material suitable for being woven between the fiberglass. Preferably, Hexcel D092 fiberglass weave, available from Hexcel Corporation, can be used for the mat. This material contains a chemical binder which acts as a wetting agent. Alternative commercially available fiberglass material includes Hexcel fiberglass weaves 1581 and 1800, offered for sale by the same company.

The longitudinal strands 32 in the mat 28 impart different strength characteristics to the marker depending on their relative angle to the housing 22. The angle 36 of the ply to the vertical plane running along the longitudinal axis 40 may be varied from 0 degrees to 45 degrees. At 0 degrees, as shown for the mat in FIGS. 1–2, the mat 28 imparts additional bending strength along the axis common to the longitudinal dimension of the marker. At 45 degrees, the angle shown at 36 in FIG. 1, the mat 28 imparts extra torsional strength. Other angles may be chosen without departing from the invention contemplated herein.

In addition to providing bending strength, torsional strength, or combination of the bending and torsional strengths, the mat 28 distributes impact loading. That is, the distribution of forces between the marker bottom 30 and adjacent pavement surface 42 to which it is attached will be more evenly spread over the entire marker-pavement contact surface. Severe impacts which otherwise might cause a portion of the marker bottom to be pushed against the roadway surface, will be better distributed to lessen the impact to any particular portion of the marker bottom and, accordingly, reduce the likelihood of damage to the marker.

Moreover, as mentioned above the fill materials generally used in potted markers, prior to the present invention, were somewhat brittle and susceptible to cracking under stress. In the event a crack begins to form in the fill material 26 above the mat 28, the lattice formed by the mat will prevent widening and spreading of the crack further into the interior of the housing. It is expected that the lattice of the mat also will prevent some cracks at or near the bottom 30 of the marker from forming at all.

The fill material used for the first preferred embodiment is that used in conventional potted type road markers. Generally, a mixture of epoxy and less expensive, non-binding materials is used to obtain an economical fill having the necessary binding characteristics. In some cases polyurethane may be used in place of part or all of the epoxy material.

The second preferred embodiment 44 like the first, uses fiberglass strands to reinforce the strength of road markers, particularly against the failure of the fill material as a result of its brittleness. Instead of using a mat of woven fiberglass in a position near the bottom surface of the marker, as shown in FIGS. 1–2, this embodiment utilizes shorter fiberglass strands for support throughout the fill material. As shown in FIG. 5, chopped strands of fiberglass 46 are distributed homogeneously throughout the height and depth of the internal fill material. The fiberglass is mixed into the epoxy/polyurethane/fill mixture when the fill is in a fluid state in order to easily blend the fiberglass evenly among the other components.

Preferably, fiberglass strands commercially available from PPG Corporation as "chopped strand, ⅛th inch, No. 3540" are used. Strands which are too long on average will be difficult to process into the fill material while strands that are too short on average will not provide the desirable support characteristics. The average length of these fiberglass strands is preferably about one-eighth to one-quarter inch. Other fiberglass strand lengths may be used, but the average strand length should be no longer than about three-eighths inch and no shorter than about one-sixteenth inch for best results.

The binding of the fibers to the fill results in a cross-linked matrix support in the fill to distribute the impact stress more evenly throughout the interior of the marker, preventing cracking of the fill in the first place and discouraging widening of any cracks which do develop. It has been found that a range of about one to about three percent of chopped fiberglass strands by weight in the fill (before drying) produces optimum strength from the cross-linking effect. Preferably, about three percent fiberglass by weight is used. While a higher percentage than three percent would be expected to provide additional strength, processing higher than a three percent concentration of fiberglass strands into the fill material presents processing problems. Three percent or lower concentration of fiberglass strands may be mixed into the liquid fill material by methods generally known in the art for mixing material into liquid epoxies.

A third preferred embodiment 48, shown in FIG. 6, utilizes reinforcement of both a mat of woven fiberglass 28 and a distribution of chopped fiberglass strands 46 in the fill material. The combination of the two types of fiberglass reinforcement is expected to provide enhanced load distribution, thereby reducing the number of cracks forming within the fill material, the size of cracks that result from impacts, and the frequency of partial or complete marker failure.

The bottom of the marker is the location of the longest and widest span of fill material between sides of the housing and, therefore, the area of greatest flex as a result of the torsional and bending forces experienced by the marker during use. The placement of the mat 28, which contains fibers lying in only one or two planes near the bottom surface locates two-dimensional support at a crucial layer to hold the fill together against torsional and bending forces. The chopped fiberglass strands 46, which are oriented in every direction, provide a three dimensional structure throughout the fill in width, height and depth directions. Hence, impact forces applied to the marker housing will be diffused through the fill material by the three-dimensional effect of the fiberglass strands above the mat, and distributed more efficiently at the bottom surface by the mat.

The third embodiment 48 is made by mixing chopped fiberglass strands 46 into the fill material 26 when it is in the liquid state, dispensing the fill material 26 into the shell 22, placing the mat of woven fiberglass 28 in the fill material 26 across the bottom surface of the marker so that the fill at least partially soaks into and through the mat, and hardening of the fill matter. This third embodiment of the inventive marker, as well as the first two preferred embodiments, may be finished off by applying a layer of sand or beads 50 to the bottom surface, adhering it to the partially hardened fill. The marker is adhered to the pavement surface by adhesive 52 known in the art. Moreover, a microthin sheet of untempered glass 54 may be adhesively attached to the outer surface of the retroreflectors as described in U.S. Pat. Nos. 4,232,979 and 4,340,319, incorporated by reference herein.

The three embodiments were tested to determine the improved strength characteristics of the preferred embodiments. The first embodiment was created by adding a mat of Hexcel D092 woven fiberglass to Stimsonite's Model 948 marker. The standard Model 948 was then tested against the Model 948 with the mat of D092 for flexure strength. The results are set forth in Table 1.

TABLE 1

| Marker Type | Flexure (Room Temp) | Flexure (Elevated Temp) |
|---|---|---|
| 948 | 673 lbs | 137 lbs |
| 948 W/D092 | 1107 lbs | 295 lbs |

The second embodiment can be prepared with varying percentages of fiberglass in the fill without departing from the concepts of the invention. Zero, one, two and three percent fiberglass was added to the fill material of a standard Stimsonite Model 88 marker. The specifications of the various examples of fill materials are disclosed in Table 2.

TABLE 2

| Component | 1% Fiber | 2% Fiber | 3% Fiber | No Fiber |
|---|---|---|---|---|
| Epoxy (g) | 47.9 | 47.9 | 47.9 | 47.9 |
| Beads (g) | 109.9 | 100.9 | 92.8 | 119.8 |
| Fibers (g) | 1.6 | 3.0 | 4.4 | — |
| Totals (g) | 159.4 | 151.8 | 145.1 | 167.7 |

What is described above is at present believed to be the preferred embodiments of the invention, but it is understood that various modifications may be made therein without departing from the scope of the invention which is to be defined by the scope of the claims appearing below.

I claim:

1. A retroreflective pavement marker comprising:

a generally hollow housing having generally horizontal top wall and including a peripheral bottom wall surface for adhesive engagement to an associated roadway, the housing having at least one inclined wall, the wall having at least one opening therethrough;

retroreflective lens means fixedly secured to the wall of the housing and visible through the opening, the lens means comprising a relatively planar front face and a plurality of cube corner retroreflective elements protruding from the rear face thereof;

a microthin sheet of untempered glass adhered to the front face of the retroreflective lens;

fill means in and filling the interior of the hollow housing, the fill means defining a bottom surface which is coplanar to the peripheral bottom wall surface of the housing, the fill means being selected from the group consisting of epoxy, polyurethane, chopped strands of fiberglass, a non-binding fill material, and mixtures of two or more of those compounds;

a mat of woven fiberglass contained in the fill means near the bottom surface of the fill means, the fiberglass being chemically treated with a binder, wherein the mat has a ply and the ply is oriented at an angle to the longitudinal axis of the housing chosen from the group consisting of 0 degrees and 45 degrees; and, a layer of abrasive material adhered to the bottom surface by the fill means, the abrasive material being selected from the group containing sand and glass beads.

2. A retroreflective pavement marker comprising:

a generally hollow housing including a peripheral bottom wall surface for adhesive engagement to an associated roadway, the housing having at least one inclined wall, the wall having at least one opening therethrough;

retroreflective lens means fixedly secured to the wall of the housing and visible through the opening, the lens means comprising a relatively planar front face and a plurality of cube corner retroreflective elements protruding from the rear face thereof; and fill means in and filling the interior of the hollow housing, the fill means defining a bottom surface which is coplanar to the peripheral bottom wall surface of the housing, the fill means including chopped strands of fiberglass, wherein the chopped strands of fiber glass comprise from about one to about three percent of the total fill means.

3. The retroreflective pavement marker of claim 2, wherein the fill means is a homogenous mixture of chopped fiberglass and other materials chosen from the group consisting of epoxy, polyurethane, non-binding filler material, and mixtures of two or more of those compounds.

4. The retroreflective pavement marker of claims 2 or 3, wherein the chopped fiberglass comprises from about one to about three percent of the total fill means.

5. The retroreflective pavement marker of claim 2, further comprising textile support means contained in the fill means near the bottom surface of the fill means.

6. The retroreflective pavement marker of claim 5, wherein the textile support means is a mat of woven fiberglass and wherein the fiberglass is starched with a chemical binder.

7. The retroreflective pavement marker of claim 6, wherein the mat has a ply and the ply is oriented at an angle to the longitudinal axis of the housing chosen from the group consisting of 0 degrees and 45 degrees.

8. In a pavement marker providing a marking on a roadway surface, the pavement marker including a generally hollow housing, the housing having at least one inclined wall, the wall having at least one opening therethrough, and including a retroreflective lens means fixedly secured to the wall of the housing and visible through the opening, and further including fill means in and filling the interior of the hollow housing, the fill means defining a bottom surface, the improvement comprising up to three percent chopped fiberglass strands in the fill means.

9. The retroreflective pavement marker of claim 8, wherein the improvement further comprises a mat of woven fiberglass contained in the fill means near the bottom surface of the fill means.

10. The retroreflective pavement marker of claim 8, wherein the fill means is a homogenous mixture of chopped fiberglass and other materials chosen from the group consisting of epoxy, polyurethane, non-binding filler material, and mixtures of two or more of those compounds.

11. The retroreflective pavement marker of claim 9, wherein the fiberglass is starched with a chemical binder, the mat has a ply and the ply is oriented at an angle to the longitudinal axis of the housing chosen from the group consisting of 0 degrees and 45 degrees.

12. In a pavement marker providing a marking on a roadway surface, the pavement marker including a generally hollow housing, the housing having at least one inclined wall, the wall having at least one opening therethrough, and including a retroreflective lens means fixedly secured to the wall of the housing and visible through the opening, and further including fill means in and filling the interior of the hollow housing, the fill means defining a bottom surface, the improvement comprising up to three percent of a homogenous mixture of chopped fiberglass and other materials chosen from the group consisting of epoxy, polyurethane, non-binding filler material, and mixtures of two or more of those compounds in the fill means and a mat of woven fiberglass contained in the fill means near the bottom surface of the fill means.

* * * * *

UNITED STATES PATENT AND TRADEMARK OFFICE

CERTIFICATE OF CORRECTION

PATENT NO. : 5,403,115

DATED : April 5, 1995

INVENTOR(S) : Michael E. Flader

It is certified that error appears in the above-identified patent and that said Letters Patent is hereby corrected as shown below:

The title page should be deleted and substituted with the attached title page, showing the illistrated figures 1 and 2.

In the drawings:
Drawing sheet 1 of 2, delete Fig.1 and Fig. 2 and substitute the attached drawing sheet 1 of 2. consisting of Figs. 1 and 2.

Drawing sheet 2 of 2, delete Fig. 3, Fig. 4, Fig. 5 and Fig. 6 and substitute the attached drawing sheet 2 of 2. consisting of Figs 3,4,5 and 6.

Signed and Sealed this

Thirteenth Day of August, 1996

*Attest:*

Bruce Lehman

BRUCE LEHMAN

*Attesting Officer*

*Commissioner of Patents and Trademarks*

United States Patent [19]

Flader

[11] Patent Number: 5,403,115

[45] Date of Patent: Apr. 4, 1995

[54] FIBERGLASS REINFORCED PAVEMENT MARKER

[75] Inventor: Michael E. Flader, Gurnee, Ill.

[73] Assignee: Stimsonite Corporation, Niles, Ill.

[21] Appl. No.: 78,968

[22] Filed: Jun. 17, 1993

[51] Int. Cl.[6] ..... E01F 9/00

[52] U.S. Cl. ..... 404/9; 404/12; 404/14; 404/16

[58] Field of Search ..... 404/9–16; 428/261, 224, 228; 524/494

[56] References Cited

U.S. PATENT DOCUMENTS

| | | | |
|---|---|---|---|
| 2,065,872 | 12/1936 | Rockwell | 404/16 |
| 3,164,071 | 1/1965 | Rubenstein | 404/10 |
| 3,332,327 | 10/1967 | Heenan | 404/16 |
| 4,113,907 | 9/1978 | Haage et al. | 428/228 |
| 4,232,979 | 11/1980 | Johnson et al. | 404/16 |
| 4,340,319 | 7/1982 | Johnson, Jr. et al. | 404/16 |
| 4,726,706 | 2/1988 | Attar | 404/14 |
| 5,155,146 | 10/1992 | Reetz | 523/222 |

*Primary Examiner*—Ramon S. Britts
*Assistant Examiner*—Pamela A. O'Connor
*Attorney, Agent, or Firm*—Jones, Day, Reavis & Pogue

[57] ABSTRACT

A potted shell style pavement marker reinforced with fiberglass in the form of a mat of fiberglass strands located near the bottom of the marker or in the form of chopped fiberglass strands distributed throughout the fill material. The mat provides support against torsional or bending stresses near the bottom of the marker. The chopped strands in the fill material provide three-dimensional support throughout the height and depth of the fill in the interior of the housing. Both means of support are expected to reduce the number of cracks that develop in the fill, to prevent the expansion of any cracks which do develop, to prevent premature disintegration of the marker, and to increase average marker life. The supporting mat and the chopped fiberglass strands can be used together in a single marker.

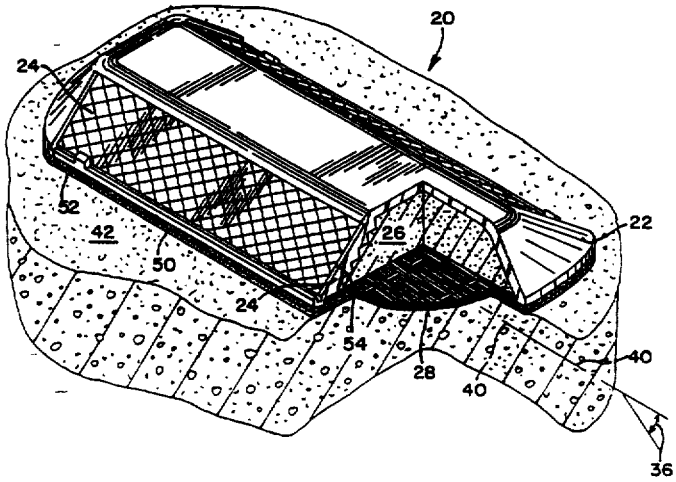

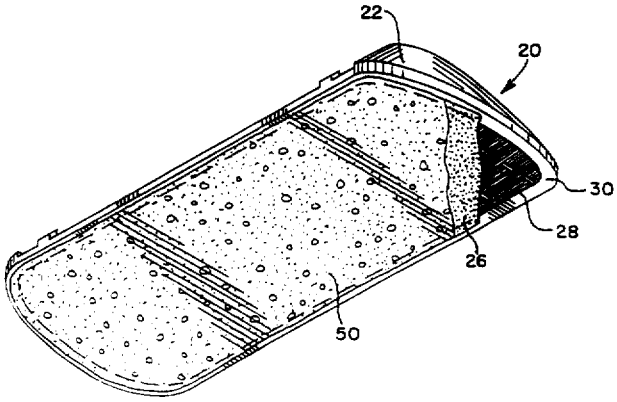

12 Claims, 2 Drawing Sheets